United States Patent [19]

Weiss

[11] 4,355,259

[45] Oct. 19, 1982

[54] HEATER FOR AN INDIRECTLY HEATED CATHODE

[75] Inventor: Eberhard Weiss, Stuttgart, Fed. Rep. of Germany

[73] Assignee: International Standard Electric Corporation, New York, N.Y.

[21] Appl. No.: 187,865

[22] Filed: Sep. 17, 1980

[30] Foreign Application Priority Data

Sep. 21, 1979 [DE] Fed. Rep. of Germany ..... 2938248

[51] Int. Cl.[3] ..... H01J 1/20

[52] U.S. Cl. ..... 313/337; 313/340; 313/341; 313/344; 313/356

[58] Field of Search ..... 313/356, 349, 337, 340, 313/341, 344

[56] References Cited

U.S. PATENT DOCUMENTS

| | | | |
|---|---|---|---|
| 1,858,676 | 5/1932 | McCullough | 313/349 |
| 2,041,904 | 5/1936 | Cone | 313/349 |
| 2,917,650 | 12/1959 | DeCaumont | 313/344 |
| 3,255,375 | 6/1966 | Ward | 313/337 |

*Primary Examiner*—Harold A. Dixon

*Attorney, Agent, or Firm*—John T. O'Halloran

[57] ABSTRACT

In a cathode heater, the portion of the coil adjacent to the emitting surface of the cathode has a smaller pitch or is covered with an oxide coating of lower capacity of heat per unit of length than the distant portion. As a result, the emitting surface is heated-up very quickly, and in a picture tube, for example, the picture comes on after a very short time. The heater according to the invention can be exchanged for a conventional heater without electrical and mechanical changes.

8 Claims, 4 Drawing Figures

HEATER FOR AN INDIRECTLY HEATED CATHODE

The present invention relates to heaters for indirectly heated cathodes as are used in picture tubes, for example.

Especially in the case of picture tubes, the user expects a picture to come on shortly after switch-on. This means that the cathode of the picture tube must be heated up very fast.

Steps to shorten the cathode heating time are described, for example, in German Published Application DE-OS No. 23 13 911 published Oct. 3, 1974. At a cathode consisting of a sleeve which is closed with a cap having an emitting coating thereon and contains a heating coil (heater) covered with an insulating coating, various measures are taken to reduce the heating time. These measures are specifically designed to achieve a temperature distribution which has its maximum value at the cap and decreases with increasing distance from the cap.

The object of the invention is to set free, as close as possible to the cathode cap, even more heat energy than has been possible so far and, thus, substantially improve the temperature distribution over the sleeve length primarily during the warm-up phase by designing the heater in a special manner.

This object is achieved in two ways which have the same effect but differ in design; they are set forth in the two first claims. They can be used separately or in combination; this as well as preferred embodiments are given in the subclaims.

Since the heaters according to the invention have virtually the same contact values and external physical dimensions as conventional heaters, they can be exchanged for conventional heaters without any change in the cathode and the heater fixing means. To manufacture heaters according to the invention, no new apparatus but only slight changes in the manufacturing process are required.

Figure 2:
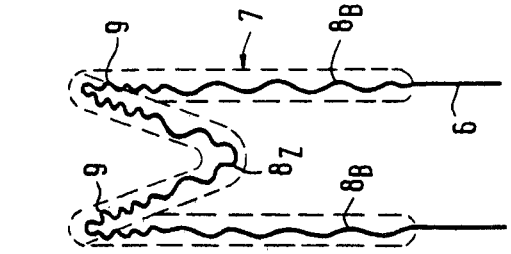
Figure 1B:
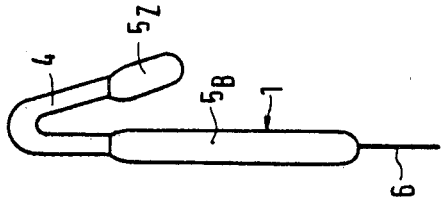
Figure 1A:
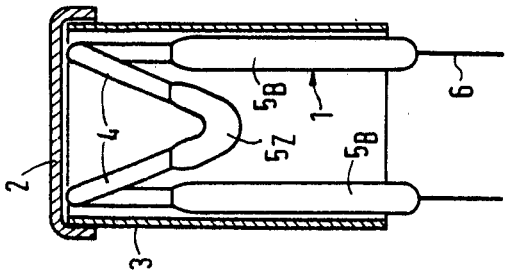
Figure 3:
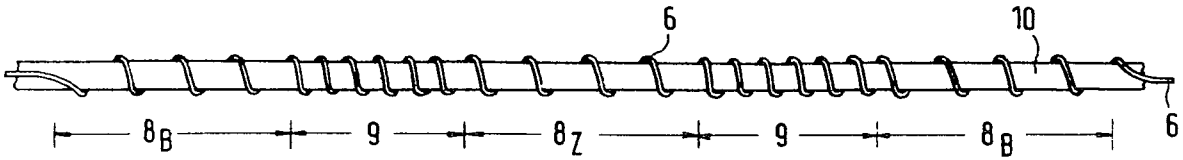

Preferred embodiments of the invention will now be explained in mord detail with reference to the accompanying drawing, in which:

FIGS. 1*a* and 1*b* are, respectively, a front view and a side view of a first embodiment of a heater according to the invention;

FIG. 2 shows a second embodiment of a heater according to the invention, and FIG. 3 shows a heating coil for the heater of FIG. 2.

FIG. 1*a* is a front view, and FIG. 1*b* a side view, of an embodiment of a heater 1 according to the invention, which has been inserted into a cathode sleeve 3 closed with a cap 2. That portion of the heater 1 which is adjacent to the cap 2 is designated 4, while the distant portion is designated $\mathbf{5}_B$ and $\mathbf{5}_Z$. The heater type shown is a so-called M heater. Other conventional heaters are in coiled-coil form. Both types are shown, for example, in German Published application No. DE-OS 15 64 462 in FIGS. 1 and 2, respectively. The present invention is applicable independently of the heater type used. What is important is that the heater should have such a length that a portion of it is adjacent to the cathode cap, while another portion is distant from the cap.

The M heater consists of the tongue and the legs of the M. The zones of the portion distant from the cap are designated $\mathbf{5}_Z$ (tongue) and $\mathbf{5}_B$ (legs).

Heaters consist of coiled heater wires (heating coils) covered with an insulating coating. In FIG. 1, only the uncoated portions of the heater wire 6 are visible. In those portions the heater wire is not coiled so that it can be better attached to heater fixing means.

As can be seen in FIG. 1, the insulating coating in the portion 4 adjacent to the cap is thinner than that in the distant portion $\mathbf{5}_B$, $\mathbf{5}_Z$. Hence, the heat radiating capacity in the adjacent portion is smaller than that in the distant portion. The effect of this will be explained by an example.

In the case of conventional heaters, the oxide coating has a mass of about 0.25 mg/mm heater-coil length. By contrast, a heater according to the invention, shown in FIG. 1, has a mass of about 0.18 mg/mm heater-coil length in the portion adjacent to the cap, and a mass of about 0.36 mg/mm in the distant portion.

When a filament voltage of 7 V is applied, a conventional heater will glow with dark red heat, which corresponds to a temperature of about 600° C., after 2 s. After 4 s the heater has reached its final temperature of about 850° C.

By contrast, the heater according to the invention will glow with bright red heat in the adjacent portion 4 after 2 s, because only a thin oxide coating must be heated up there. In the distant portion with a thicker oxide coating, i.e., with higher heat radiating capacity, the heater according to the invention will not reach dark red heat until after about 3 s.

Besides depending on the different heat radiating capacities, the different warm-up times of the two portions are determined essentially by the temperature-dependent electric resistance of the heater coil, usually a tungsten heater coil.

The resistance of a tungsten wire at 20° C. is 0.055Ω m/mm$^2$. If the resistance is assumed to be one at 20° C., it is three at 430° C., four at 630° C., and five at 820° C. In the case of a conventional heater, which reaches about 600° C. after 2 s, the resistance along the overall length is about four. In the case of a heater according to the invention, the resistance in the colder, distant portion is about three, and that in the hotter, adjacent portion is about five. In both cases, the resistance along the overall length of the heater and, hence, the current flowing are about the same. However, the heater power is calculated from the product of the resistance and the square of the current. Since the current remains nearly unchanged, while the resistance in the adjacent portion of the heater according to the invention is higher than that of a conventional heater, the power in the adjacent portion of the heater according to the invention is higher, too.

In the case of the heater according to the invention, low heat radiating capacity and high electric resistance in the adjacent portion cause the adjacent portion to heat-up considerably faster than in the known heater; during the first warm-up phase, they even cause the temperature in the adjacent portion to exceed the operating temperature, which is reached after some time. As a result, the cap and, consequently, the electron emissive coating on the cathode heat up very quickly. Later, at thermal equilibrium, there is no difference any more between the temperature distribution of a conventional heater and that of a heater according to the invention.

Instead of by different thicknesses of the oxide coating, the different heat radiating capacities can also be achieved by depositing a porous oxide coating in the adjacent portion, and a compact oxide coating in the distant portion.

FIG. 2 shows an embodiment of a heater 7 in accordance with the second solution to the problem. Here the oxide coating covering the coiled heater wire 6 is only indicated by broken lines. As can be seen, the heating coil has a large pitch in the distant portion $8_B$, $8_Z$ of the heater but a small pitch in the adjacent portion 9. The indices B and Z have the same meaning as that explained in connection with FIG. 1.

The thermal effects are very similar to those explained in connection with FIG. 1. Because of the small pitch in the adjacent portion, the latter heats up faster than the distant portion, which has a greater pitch. As a result of the faster warm-up, the resistance increases sharply, which further promotes the heating process. The overall length of the wire is again chosen so that at the same heater voltage, the same current flows through a conventional heater and through the heater according to the invention. After the temperature differences have been compensated for, at thermal equilibrium, there is again hardly any difference in the temperature distribution between a heater according to the invention and a conventional heater. Because of the fast warm-up of the adjacent portion, however, the cathode heating time is reduced considerably. While in conventional heaters, 90% of the cathode current flows after about 4.5 s, which is reached at thermal equilibrium, this percentage is reached in heaters according to the invention already after about 3.5 s.

Heaters according to the invention can be produced as follows: A heating coil bent into an M or into another shape is immersed in an electrophoresis bath until about 0.18 mg oxide/mm have deposited. Then the heating coil is taken out of the electrophoresis bath and immersed in a washing bath to the point that the oxide coating in the adjacent portion is washed away. After this rinsing with water, the heating coil is again immersed in the electrophoresis bath, and another 0.18 mg oxide/mm are deposited. The subsequent treatment is as usual. By this method, the adjacent portion of the heater is provided with a thin oxide coating, while the distant portion is provided with a thick oxide coating.

The method may be modified by changing the composition of the second bath and applying a different voltage so that electrolysis accompanied with generation of gasses will occur. Thus, the second oxide coating becomes porous and, therefore, has a still lower heat radiating capacity than the compact coating.

A heater as shown in FIG. 2, whose coil has different pitches, can be produced by a method as will now be described with the aid of FIG. 3. A tungsten wire is wound onto a 0.175-mm diameter core wire 10 of molybdenum; 42 windings/cm are wound onto the portion $8_Z$ over a length of 7.2 mm and onto each of the portions $8_B$ over a length of 4.1 mm, while 90 windings/cm are wound onto each of the portions 9 over a length of 4.2 mm. Then, the core wire with the heater wire wound thereon is etched in an acid bath as usual. The oxide coating may be applied in the conventional manner or as described in the preceding paragraphs.

In preferred embodiments of heaters according to the invention, the length of the adjacent portion of the heater is about one third of the overall length.

I claim:

1. Heater for an indirectly heated cathode wherein a heating coil covered with an insulating coating is positioned within a cathode sleeve closed with a cap having an emitting coating thereon, one portion of the heating coil being adjacent to the cap, and the other being distant from the cap, characterized in that that portion (4) of the heating coil (6) which is adjacent to the cap (2) has a lower heat radiating capacity per unit length of the heating coil than the distant portion ($5_Z$, $5_B$).

2. A heater for an indirectly heated cathode wherein a heating coil covered with an insulating coating is positioned within a cathode sleeve closed with a cap having an emitting coating thereon, one portion of the heating coil being adjacent to the cap, and the other being distant from the cap, characterized in that in the portion (9) adjacent to the cap (2), the heating coil (1) has a smaller pitch than in the distant portion ($8_Z$, $8_B$).

3. A heater as claimed in claim 1 or 2, characterized in that in the portion (4) adjacent to the cap (2), the heating coil (1) is covered with a thinner insulating coating than in the distant portion ($5_Z$, $5_B$).

4. A heater as claimed in claim 1 or 2, characterized in that the heating coil (1) is covered with a porous insulating coating in the portion (4) adjacent to the cap (2), and with a dense insulating coating in the distant portion ($5_Z$, $5_B$).

5. A heater as claimed in claim 1 or 2, characterized in that the heating coil (1) is covered with a dense coating in the portion ($5_Z$, $5_B$) distant from the cap (2), and that a porous coating is applied to this dense coating and to the remainder of the heating coil (1).

6. A heater as claimed in any one of claims 1 or 2, characterized in that the heating coil (1) is folded into an M.

7. A heater as claimed in any one of claims 1 or 2, characterized in that the heating coil (1) has the shape of a coiled coil.

8. A heater as claimed in any one of claims 1 or 2, characterized in that the length of the portion (4, 9) adjacent to the cap (3) is about ⅓ of the overall length of the heating coil (1).

* * * * *